United States Patent [19]

Debetencourt

[11] Patent Number: 4,779,764

[45] Date of Patent: Oct. 25, 1988

[54] POURING STOPPER

[75] Inventor: Jean Debetencourt, Maulde, Belgium

[73] Assignee: Lynes Holding S.A., Luxembourg, Luxembourg

[21] Appl. No.: 38,772

[22] Filed: Apr. 15, 1987

[30] Foreign Application Priority Data

Nov. 19, 1986 [BE] Belgium ..... 217442

[51] Int. Cl.[4] ..... B65D 47/10

[52] U.S. Cl. ..... 222/83; 222/91; 222/153; 222/521; 215/250

[58] Field of Search ..... 215/250, 253, 256; 222/81, 83, 83.5, 91, 521

[56] References Cited

U.S. PATENT DOCUMENTS

| | | | |
|---|---|---|---|
| 2,066,390 | 1/1937 | Cahoon et al. . | |
| 2,582,224 | 1/1952 | Boadway | 222/521 |
| 3,580,423 | 5/1971 | Gilman | 222/81 |
| 3,735,905 | 5/1973 | Badavas et al. | 222/521 |
| 3,802,604 | 4/1974 | Morane et al. | 222/83 |
| 4,307,821 | 12/1981 | McIntosh | 222/83 |
| 4,383,623 | 5/1983 | Page | 222/521 |

FOREIGN PATENT DOCUMENTS

| | | | |
|---|---|---|---|
| 0187567 | 7/1986 | European Pat. Off. . | |
| 0214095 | 3/1987 | European Pat. Off. . | |
| 2644947 | 4/1978 | Fed. Rep. of Germany . | |
| 2049485 | 3/1971 | France . | |
| 2565208 | 12/1985 | France . | |
| 318365 | 12/1956 | Switzerland | 215/250 |

*Primary Examiner*—Donald F. Norton

*Attorney, Agent, or Firm*—Fleit, Jacobson, Cohn & Price

[57] ABSTRACT

A pouring-stopper device for a container, comprising a stopper and a cover or seal movable relative to said stopper, in which said cover and stopper are provided with complementary means preventing separating the one from the other, the first movement of said cover relative to the stopper, which follows tearing the guarantee strip away, causing piercing of a lid, said first movement simultaneously causing in said cover, an outlet to be formed for the product contained in said container.

7 Claims, 3 Drawing Sheets

POURING STOPPER

This invention has for object a pouring-stopper device.

The invention has more particularly for object such a device which is usable for closing containers of bottle or decanter type which are intended to contain paste-like or viscous products.

The stoppers for containers containing such products have to comply with various conditions, sometimes conflicting ones, such as being easy to handle, having a low cost, being suitably tight to avoid deteriorating the qualities of the contained product, while insuring the safety guarantees required both from the product users as regards the container content integrity as it is used for the first time, and from the product manufacturers as regards also preserving the qualities of said products inside the container, with time.

To fulfill such conditions, particularly the above conditions, there have already been proposed pouring stoppers which comprise an inner lid in the form of a diaphragm which seals the container mouth on the one hand, and on the other hand a guarantee or inviolability strip which is to be removed before using the container for the first time, to have access to the content thereof. An example of such a device, more particularly provided to comply with the rules pertaining to conditioning harmful liquids, is described in FR-A-2 565 208. There is provided a lid for closing the container mouth, moulded in one piece with a pouring member it can be stripped from, in such a way that the lid the device does comprise has first to be removed from the pouring element to obtain access to the lid, the lid thus can not be made integral with the pouring element. Such an arrangement, that is a lid integral with the pouring element is however of great interest for many applications, notably regarding conditioning containers for food products such as for example, without any limitation whatsoever, flexible containers for seasonings such as mustard, ketchup, etc., or products such as shampoos, etc.

It is precisely one object of the invention to provide an improved pouring-stopper device which complies with all the above-defined required conditions, particularly the last-mentioned one.

One object of the invention in this respect is to provide such a device wherein the mouth of that container it is fitted on, is closed by a lid as long as a first handling did not occur, and which prevents such handling as long as an inviolability strip has not been removed.

One object of the invention is also to provide such a pouring-stopper device which is well suited to be fitted to containers for paste-like or viscous products, because it does insure permanently some protection to the container content, while making closing and opening simple and reliable.

A pouring-stopper device according to the invention, notably for a flexible container of that type intended to contain a paste-like or viscous product comprising a stopper proper in the shape of a cap provided with means for fastening to the container neck, and a cover or seal movable relative to said stopper proper, as well as a guarantee or inviolability strip tearably connected to said cover and which cooperates with said stopper proper to prevent any relative movement of the cover with respect to the stopper proper as long as it has not been torn away, is characterized in that the cover and the stopper proper are provided with complementary means preventing separating one from the other while insuring guiding the movement of the first one relative to the second one, the first movement of said cover relative to the stopper proper which follows stripping of the guarantee strip, causing piercing of a diaphragm-like lid which is joined with bothe sides thereof on the one hand to the container mouth opening, and on the other hand to the stopper proper, said first handling simultaneous causing in said cover, unclosing an outlet for the product contained inside the container.

In a preferred embodiment, said complementary means are comprised most simply of a cam-away and helical screwing teats coupled together and provided the one on the cover and the other ones on the stopper proper.

In this embodiment, according to another feature of the invention, slots are provided in the top of the stopper proper, said slots which are closed as long as the diaphragm-like lid has not been pierced, serving to let through members for piercing said lid, which members are integral with the cover, during the first relative movement of the stopper and cover.

In a preferred embodiment, the invention provides for the stopper proper to bear on the top side thereof, a finger facing inwardly of the container when the stopper is in position, with such a height that the first handling of the cover relative to the stopper proper, causes the stopper-removed end of said finger to cooperate with a capsule for sealing an opening in said cover, to cause stripping thereof and thus forming the outlet for that product which is contained in the container.

In still another embodiment of the invention, that top side of the stopper proper which bears said finger, further bears a funnel co-axial with said finger and the diameter of which is substantially the diameter of a circle bounding said slots provided in said side and shaped as ring-like crown portions.

When the piercing members are provided by punches or similar arranged on the ends of a skirt depending from the cover, there is advantageously provided for the skirt diameter to be slightly smaller than the funnel diameter in the stopper proper, which makes somewhat easier the transversing/rotating movement of the cover relative to the stopper proper on the one hand, and on the other hand enhancing the closure tightness when shoulders, rims or similar are provided on the free edge of the cover and funnel, respectively.

Other details and features of the invention will stand out from the following description, given by way of non limitative example and with reference to the accompanying drawings, in which.

Figure 1:
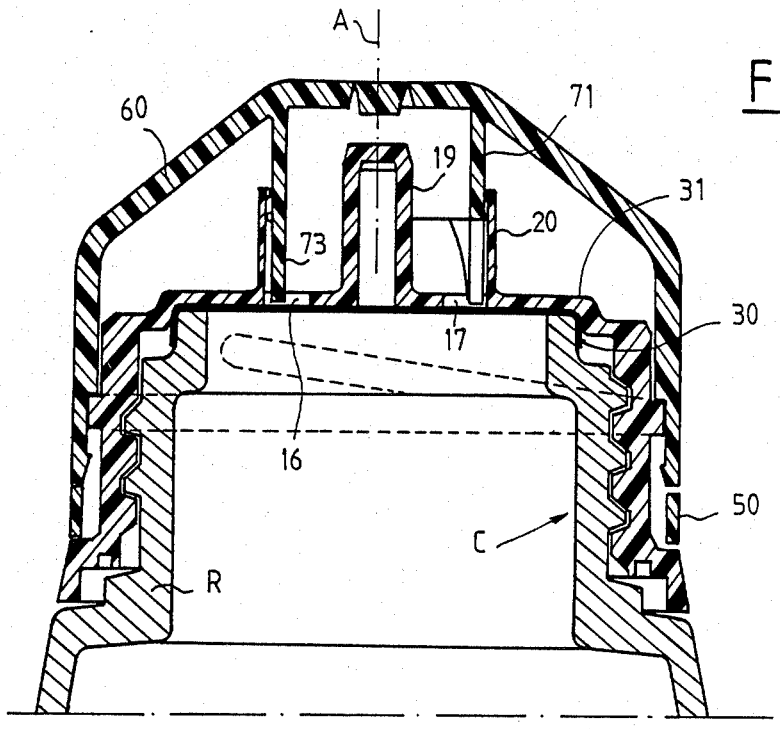
FIG. 1 is a general view of the pouring-stopper device according to the invention, prior to the first handling or operation thereof.

Reference will first be made to FIGS. 1 to 5 which show the structure of a device according to the invention, to be fitted to a container R, of flexible-wall type and intended to enclose a paste-like or viscous product. It does essentially comprise a stoppr proper 10, FIGS. 2 and 3, and a cover or capsule 11, FIGS. 4 and 5. The stopper 10 proper, from suitable plastic material, for example, is moulded as cylinder-like body 12 having on the inner side thereof, a screw-thread 13 for cooperating with a corresponding screw-thread on neck C from container R, and a flat end wall 15 connected to body 12 through a fold or shoulder 14. Wall 15 is pierced with at least two opposite slots 16 and 17 which have in plan view somewhat the shape of a crown portion and wherebetween stands, projecting from the outer surface 18 of wall 15, a hollow finger 19 directed opposite to body 12 relative to said wall 15. There further projects therefrom a funnel 20 co-axial with finger 19, the diameter of which is substantially equal to the diameter of that circle bounding said slots 16 and 17 along the outer circumference thereof, and which has at the outer end thereof and on the inner surface thereof, a slight rim 20*a*.

At that end thereof remote from the end connecting to wall 15, said body 12 is shaped as a truncated cone-like skirt 25, providing along the outer surface thereof, a flat bearing area 26 joined to the outer surface 27 of said body by a bevel 28, and on the inner surface 29 thereof, said skirt has rack-like teeth, not shown, which can cooperate with corresponding teeth, also not shown, on neck C from container R to prevent removing the stopper proper from said container which, previously to arranging said stopper in position and after filling, is closed on the mouth thereof by a lid 30, advantageously a heat-sealed diaphragm over the flat end surface 31 of neck C.

Figure 4:
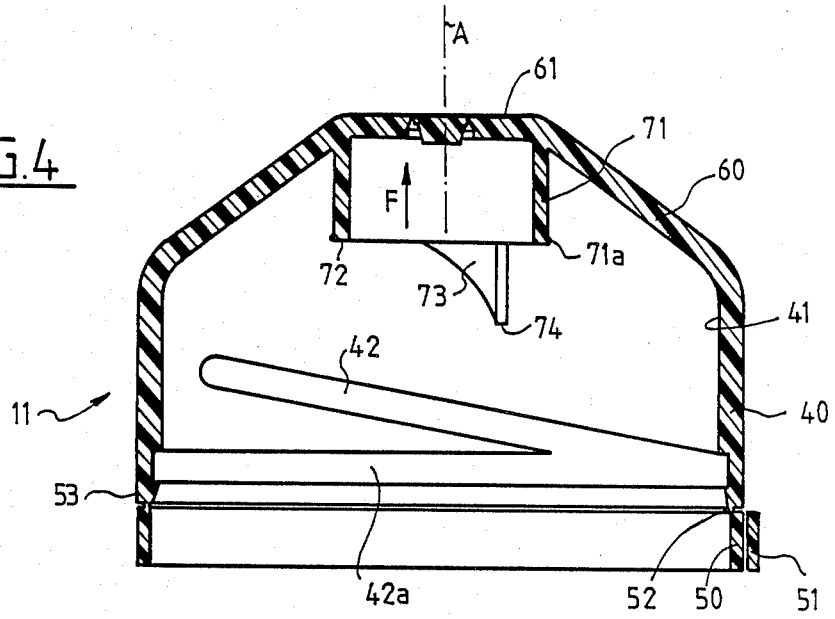
FIG. 4 is a section view along line 4—4 in FIG. 5, showing the capsule or cover provided with the inviolability strip thereof.
Figure 5:
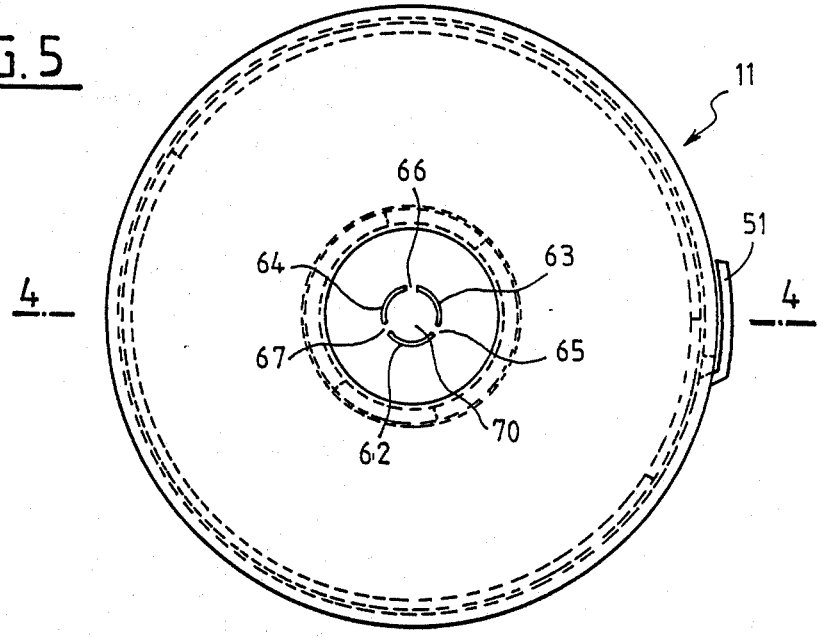
FIG. 5 is a top view of the capsule or cover of the pouring-stopper device according to the invention.

With the stopper proper 10 can cooperate the cover or capsule 11, FIGS. 4 and 5, which comprises in the embodiment as shown and described, a cylinder-like body 40 the inner surface 41 of which is provided with cam-ways 42, the one of which is shown in FIG. 4, said cam-ways extending from a circular groove 42*a* provided adjacent to the body free edge, and being so provided as to cooperate with at least two teats 45 and 46 with corresponding shapes and sizes, which are provided in equally-distant areas on the outer surface 27 of stopper body 12.

There is fastened to the free end of cover body 40, an inviolability strip 50 the one end of which has a grip tab 51 allowing easily tearing away said tab from body 40 it is connected to through a very thin area 52, or through small bridges, whereby the height of said strip 50 as measured in parallel relationship with device axis. A, is substantially equal to that spacing between the circular lower edge 53 of body 40, and stopper bearing surface 26 when said stopper proper and the cover are secured to one another, in a first condition of the pouring stopper as shown in FIG. 1 and corresponding to the condition as the container leaves the conditioning works, that is particularly with lid 30 unharmed and teats 45 and 56 inside groove 42*a*.

On that end removed from the end the guarantee strip 50 is originally fastened to, the body 40 merges into a truncated cone-shaped part 60 which ends in a wall 61 substantially at right angle to device axis A, and the middle area of which is cut-out along arcs of circle, as shown in 62, 63 and 64 in FIG. 5, to provide a center pad 70 joined to the wall remaining portion through small thin bridges 65, 66, 67 which are easy to break when a force directed along a narrow F is applied by finger 19 to said pad.

There depends from wall 61, inwardly of the cover, a skirt 71 with an outer diameter which corresponds substantially to the inner diameter of funnel 20, and which has at the free end thereof, a slight rim or shoulder 71*a*, similar to rim 20*a* from funnel 20. The skirt 71 is also shaped on the free edge 72 thereof, as at least two opposite punches 73 each having a point 74, and which face when the device is assembled, said slots 16 and 17 from stopper 10 proper, whereby said slots are then covered by lid 30.

The operation of the device according to the invention appears immediately from the above.

After filling container R with the product it should contain, the lid 30 is heat-sealed over the container mouth, in the case of heat-sealing by conduction, and the whole device, that is stopper 10 proper and cover 11, is added to container neck C by screwing-on. With heat-sealing by induction, the stopper/lid unit, after filling, is screwed on the container and heat-sealed. When it is desired, starting from such condition, to use the container for the first time, one first proceeds with tearing the inviolability strip 50 away, simply by pulling tab 51. There is then no obstacle any more to the relative movement of the cover with respect to the stopper proper and the lid 30 may then be pierced by moving cover 11 relative to the stopper proper, by moving the cover forward with a helical motion which causes the cam-ways 42 and teats 45 and 46 to cooperate until said cover has been brought to the position as shown on the left-hand side of FIG. 6. During such movement, the punches 73 pierce the lid 30 and cut same away substantially along the circumference of slots 16, 17.

Figure 6:
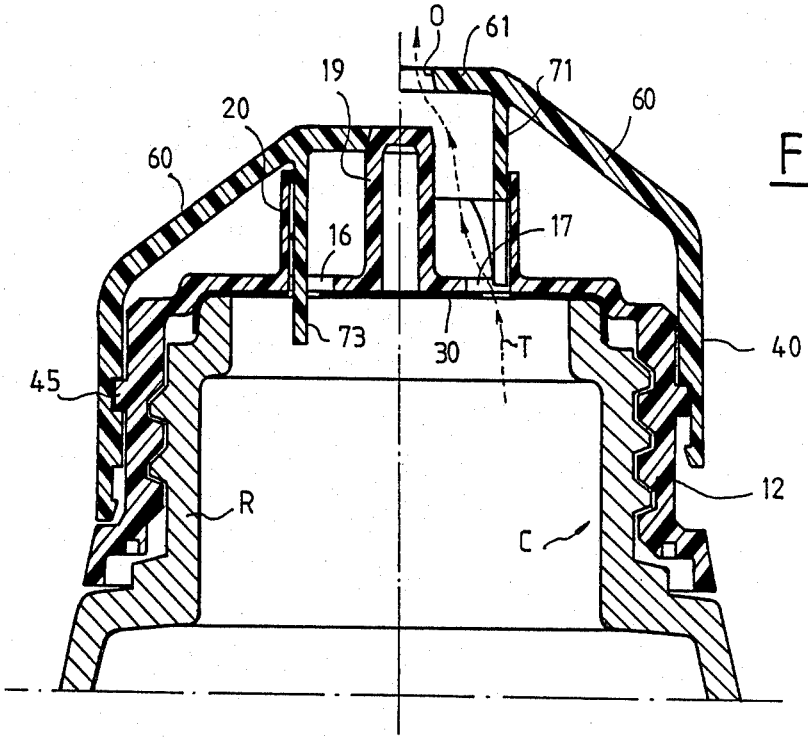
FIG. 6 shows two half-views of the pouring-stopper device, for different use conditions thereof.
Figure 2:
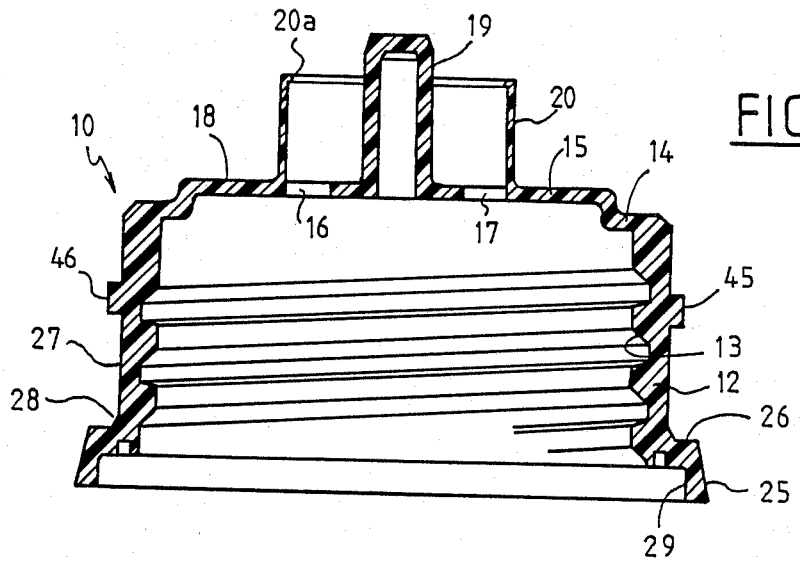
FIG. 2 is a view of the stopper proper, in section along line 2—2 in FIG. 3.
Figure 3:
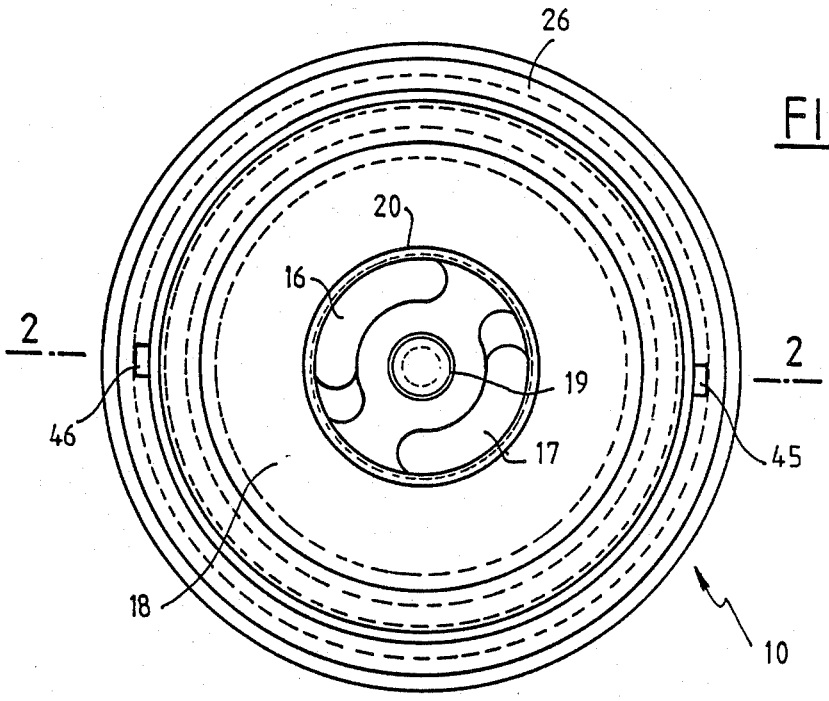
FIG. 3 is a bottom view of said stopper proper.

Simultaneously, during said first handling or operation, the cooperation of finger 19 with pad 70 from wall 61 causes the small bridges 65, 66 and 67 to break to form the product outlet O, as shown on the right-hand side of figure 6, where the outlet path for the product is shown by a dotted arrow T, from the container, through the slots 16, 17, into the space left between finger 19 and skirt 71, to outlet O.

When after using the container, said container has to be closed again, operating in reverse the cover relative to the stopper insures closing, that is the return to the condition as shown on the left-hand part of FIG. 6.

The presence of shoulders 71*a* and 20*a* which cooperate with funnel 20 and skirt 71 respectively, conduces to a good tightness.

What is claimed is:

1. A pouring stopper device for use on a flexible container of the type for containing a paste-like viscous product and which has a neck sealed by a diaphragm-type lid, the device comprising a stopper in the shape of a cap provided with means for fastening to the container neck, a cover mounted on the stopper, a frangible element in the cover for defining a discharge opening when broken away, a guarantee strip tearably connected to the cover and cooperating with the stopper to prevent relative movement of the cover with respect to the stopper while the tear strip is in tact, wherein the cover and stopper are provided with complementary means for guiding the cover in up and down movement relative to the stopper after tearing the guarantee strip away, the cover including piercing means for piercing the lid of the container when the cover is initially moved down on the stopper and the stopper including pressure means for breaking away said frangible element on the cover when the cover is initially moved down the stopper, for subsequently obturating the discharge opening when the cover is in a down position on the stopper, and for freeing the discharge opening when the cover is in an up position on the stopper.

2. A device as claimed in claim 1, wherein the complementary means comprises projecting means on one of the stopper and cover and complementary receiving means on the other of the stopper and cover for threading the cover up and down on the stopper.

3. A device as claimed in claim 1, wherein the frangible element is centrally located in the cover, and the pressure means comprises a central upstanding finger on a top wall of the stopper.

4. A device as claimed in claim 3, wherein the stopper has plural slots in the top wall around the finger and wherein the piercing means comprises plural piercing projections extending downwardly from a top wall of the cover around the frangible element, the projections being adapted to penetrate the slots for piercing said lid.

5. A device as claimed in claim 4, wherein the complementary means comprises means for threading the cover up and down on the stopper and wherein the slots and the piercing projections are correspondingly arcuately configured.

6. A device as claimed in claim 5, which includes an upstanding first cylindrical wall on the top wall of the stopper, the cylindrical wall surrounding the piercing projections and limiting downward movement of the cover on the stopper.

7. A device as claimed in claim 6, wherein the piercing projections are formed on a second cylindrical wall extending inwardly from the top wall of the cover, wherein the second cylindrical wall fits in the first cylindrical wall and wherein said cylindrical walls have cooperating rim seals.

* * * * *